United States Patent [19]

Coone

[11] 4,077,224

[45] Mar. 7, 1978

[54] METHOD AND APPARATUS FOR GROUTING AN OFFSHORE STRUCTURE

[75] Inventor: Malcolm G. Coone, Houston, Tex.

[73] Assignee: Lynes, Inc., Houston, Tex.

[21] Appl. No.: 686,024

[22] Filed: May 13, 1976

[51] Int. Cl.[2] ..... E02B 17/00

[52] U.S. Cl. ..... 61/94; 61/100

[58] Field of Search ..... 61/94, 100, 97, 54, 61/53.5, 53.52, 82, 98; 277/34

[56] References Cited

U.S. PATENT DOCUMENTS

| | | | |
|---|---|---|---|
| 3,457,728 | 7/1969 | Pogonowski | 61/94 |
| 3,564,856 | 2/1971 | Blount et al. | 61/94 |
| 3,601,999 | 8/1971 | Olsen | 61/94 |
| 3,839,872 | 10/1974 | Loire | 61/98 |
| 3,878,687 | 4/1975 | Tragesser, Jr. | 61/100 |
| 3,967,456 | 7/1976 | Stone | 61/102 |

*Primary Examiner*—Jacob Shapiro

*Attorney, Agent, or Firm*—William C. Norvell, Jr.

[57] ABSTRACT

Inflatable seal means are provided on the jacket or sleeve of a supporting leg of an offshore structure to seal off therebetween and a piling which the jacket surrounds. The seal means is expanded inwardly to sealingly engage the piling and water is then expelled from the space between the jacket and the piling and grouting material is introduced into the space. Pressure is maintained on the grouting material in the space until it takes a permanent set.

3 Claims, 7 Drawing Figures

METHOD AND APPARATUS FOR GROUTING AN OFFSHORE STRUCTURE

CROSS-REFERENCE TO RELATED APPLICATIONS

A specific form of seal means and arrangement is as disclosed and claimed in the application of Erwin E. Hoffman, which application is assigned to the assignee of this application, said co-pending application bearing Ser. No. 606,137, filed on Aug. 4, 1975, for "Seal Arrangement and Flow Control Means Therefor." The present method is also related to the co-pending application of Malcolm G. Coone and Erwin E. Hoffman assigned to the assignee of this application, said application bearing Ser. No. 603,029, filed on Aug. 4, 1975, for "Grouting System and Arrangement for Offshore Structure."

BACKGROUND OF THE INVENTION

1. Field of The Invention

The invention relates to a method and apparatus for grouting an offshore structure such as a platform for use in conjunction with the drilling and production of a subterranean well.

2. Description of the Prior Art

Various types of grouting procedures for the annular space between the jacket and piling for offshore structures have been heretofore provided. The patent to Manning, U.S. Pat. No. 3,213,629 discloses a method of installing a pile wherein the pile is positioned within the jacket and thereafter the pile is hammered into the sea bed to such an extent that the upper end of the pile is below the top of the jacket and the surface of the water, and the hammer follows the pile downwardly within the jacket. While the pile is being driven, the water level within the jacket is lowered at a rate which maintains the water level below the lower face of the hammer. Thereafter, the grouting procedure is initiated.

The patent to Harris, U.S. Pat. No. 3,468,132 discloses a packer assembly for sealing an annular area between pilings and skirt guides for insertion of the piling, the guides being located at the bottom of platforms and secured by means of the piling to the floor of the sea. The annular area between the guides and the piling is filled with grout above the packer assembly after setting of the packer upon completion of driving of the piles.

The patent to Thaxton, U.S. Pat. No. 3,570,259 entitled "Annulus Seal and Pile Wiper" discloses a seal for sealing the annulus between a pile and a platform leg for subsequent cementing or grouting.

The patent to Olsen, et al., U.S. Pat. No. 3,601,999 teaches the use of compressed air which is introduced into an annular area between the platform jacket and the piling so that water can be expelled from the annular area through the lower end of the platform jacket or sleeve for subsequent introduction of a grouting material. The introduction of compressed air and grouting material is effected from above the water line, thus avoiding any necessity of having to perform the grouting step by utilizing divers.

The patent to Bassett, U.S. Pat. No. 3,811,289 discloses the use of a predetermined amount of grout for introduction from the top into the annular area between the piling and a leg sleeve or jacket. The amount of material is calculated to be sufficient to displace water from the space through the lower end of the jacket.

Upon setting, the grout forms a plug in the bottom portion of the annular area. Additional grout then is introduced to fill the upper portion of the annular space and is allowed to set.

The patent to Bassett, et al., U.S. Pat. No. 3,832,857 discloses a method for grouting the annular area between the jacket and the platform leg which utilizes air introduced into the annular area to expel water from the lower end of the annular area. Thereafter, the annulus is filled from the top with the grouting material. Water may be pumped down the annular area to wash out any mud. Additionally, a minor amount of grouting material may be pushed out the bottom of the annular area to remove mud or to form a bell shaped foundation.

The strength of a cement-like material, such as grout, is the resistance which it offers to being crushed (which is defined as its compressive strength) or pulled apart (which is defined as its tensil strength). These two types of strengths are, of course, related, with compressive strength generally ranging from about 5 to about 10 times higher than the tensil strength of given samples of set cement.

Normally, the testing of the compressive strength of cement is conducted under very strict, uniform requirements. Cubes of cement slurry generally are allowed to set and cure under a water blanket, either at atmospheric pressure or at a specified pressure, usually up to, but no more than, about 3000 p.s.i. Cement cured under pressure generally will have a higher compressive strength than a similar sample which has been cured only at atmospheric pressure.

The coefficient of friction between surfaces is the ratio of the force required to move one surface over the other surface in relation to the total force compressing the two surfaces together. Thus, if "F" is the force which is required to move one surface over another, and "W" is the force pressing the surfaces together, the coefficient of friction may be defined by the formula: $K = F/W$.

The coefficient between two samples of grout, one over the other, is approximately 1.8 times the coefficient of friction between steel and a similar section of grout. Therefore, if the plane of shear between a piling and a piling sleeve, which is normally steel on grout, can be shifted to produce a shear plain of grout on grout, then the force necessary to shift the piling either in or out of the piling sleeve is greatly enhanced.

Utilizing prior art grouting methods, the configuration of piling with respect to the piling sleeve, where no pressure has been applied to the grout, is as shown in FIG. 6. Here, the plane of shear is between the grout and steel as indicated by lines A—A and B—B. However, by utilizing the method of the present invention, pressurizing the annular area between the piling and the sleeve will cause the sleeve to flex in an outward position and the piling to flex in an inward position. As a result, two beneficial effects are obtained. First, a greater volume of grout may be placed within the annular area which shifts the plane of shear to A'—A' and B'—B' as shown in FIG. 7. As a result of this first beneficial effect, the plane of shear is now grout on grout, as opposed to grout on steel. Accordingly, the shear out characteristics of the piling have been greatly increased, in addition to providing greater stability between the piling and the piling sleeve. The ultimate result is a more stable and safe platform structure.

It is an object of the present invention to seal off the upper and lower end of a sleeve which surrounds a piling and then filling the space between the jacket and the piling with grouting material.

Another object of the present invention is to close off the upper and lower end of the sleeve surrounding the piling by utilizing expanding inflatable seal means to seal off the space therebetween, thereafter filling the space with grouting material and maintaining a pressure greater than the static head pressure exerted by the grout column and water column at the grouting depth on the grouting material in the space until it has set.

A further object of the invention is to fill the annular space between a piling and a surrounding jacket or sleeve by providing seal means adjacent the upper and lower end of the jacket, providing inflating fluid to the seal means to maintain the space closed off and thereafter injecting grouting material into the space while retaining the inflating pressure trapped in the seal means.

Yet a further object of the invention is to fill the annular space between a piling and a surrounding jacket or sleeve by providing expandable seal means adjacent the upper and lower end of the jacket, providing inflating fluid to the seal means to inflate the seal means to maintain the space closed off and thereafter injecting grouting material into the space while retaining the inflating pressure trapped in the expanded seal means and maintaining a pressure greater than the static head pressure exerted by the grout column and water column at the grouting depth on the grouting in the space until the grout has taken a permanent set.

Still a further object of the present invention is to provide a method of grouting the annular area between the piling and a platform sleeve whereby the coefficient of friction is transferred from grout on steel to grout on grout.

Other objects and advantages of the present invention will become apparent from a reading of the figures, the description and the claims which follow.

DESCRIPTION OF THE PREFERRED EMBODIMENTS

Figure 1:
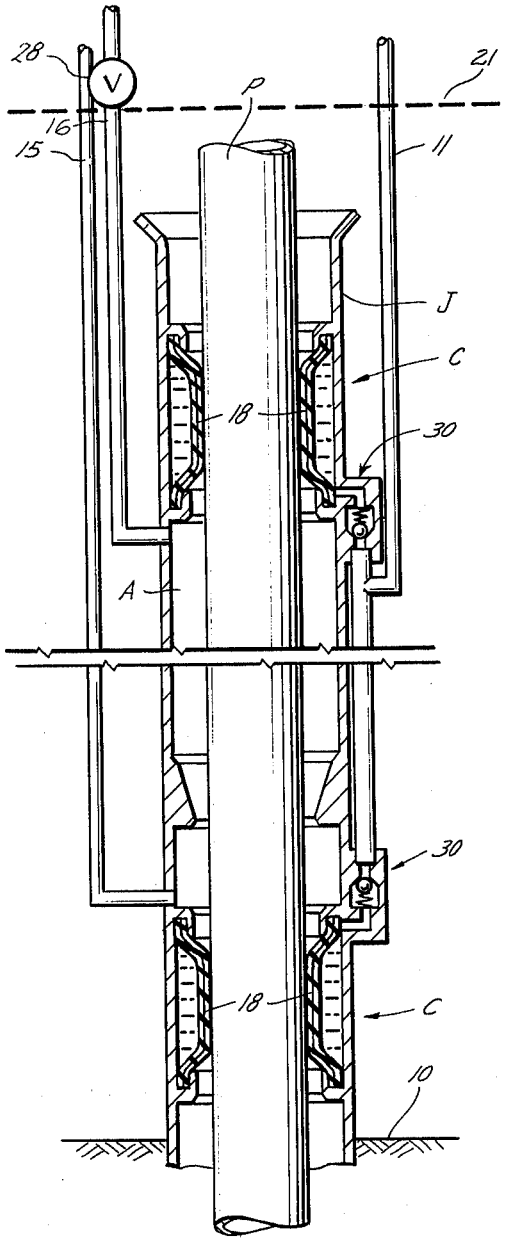
FIG. 1 is a schematic diagram illustrating one arrangemeth for carrying out the process of the present invention and showing spaced expandable closure means positioned adjacent the upper and lower end of a jacket which surrounds a piling that is positioned in a seabed with suitable conduit means for providing inflating fluid to the closure means for expanding the seal means and for providing grouting material to the space between the closure means.

Attention is first directed to FIG. 1 of the drawings wherein a jacket J is shown as surrounding a piling P received therethrough. Closure means referred to generally by the letter C are provided adjacent the upper and lower end of the jacket with the lower closure means C being positioned adjacent the seabed or seafloor 10 on which the offshore structure is positioned. Such closure means are shown as comprising a reinforced elastomer body 18 of known construction positioned on the inside of the jacket means J. An inflation conduit 11 is provided which extends upwardly to above the surface of the water in which the offshore structure is positioned for conducting an inflating medium to each of the inflatable elements 18, for expanding them into sealing engagement with the piling P, and for sealing off the space between the jacket J and piling P between the closure means C. The conduit 11 is provided with an arrangement referred to generally as 30 which serves to trap the inflating medium within the inflatable elements 18 after they have been inflated.

After the closure means C have been moved to the position shown in FIG. 1 to seal off the annular space A therebetween, grouting material of any suitable and known type is then discharged through the conduit 15 and into the space A between the spaced, inflatable packers. If desired a grout return line 16 may be provided so as to obtain a visual or instrumental indication as to when the water from the space A has been displaced by the grouting material to indicate the operation is complete. Once grout returns are witnessed at the surface, the return line valve 28 is manipulated to closed position and pressure is applied within the grout lines 15 and 16.

Figure 2:
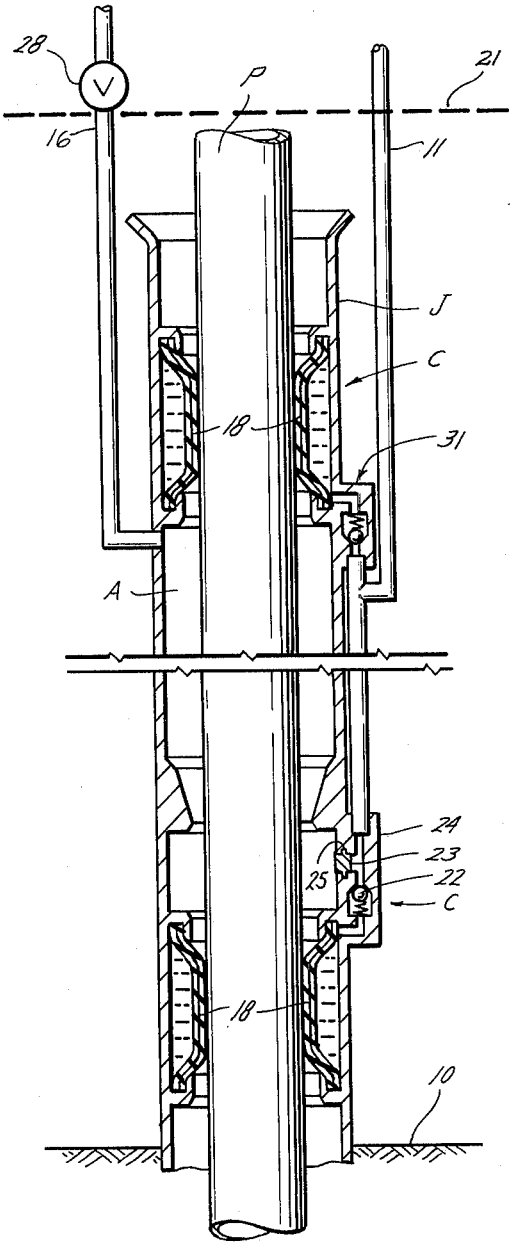
FIG. 2 is similar to FIG. 1 but shows a single line for accomplishing the inflation of the expandable seal means and for supplying grouting to the annular space between the jacket and piling between the seal means.

In FIG. 2, the grouting line 15 has been omitted, and the conduit 11 is provided with an alternate arrangement referred to generally as 31 in FIG. 2 for trapping or maintaining the inflating fluid within the inflatable element and for providing an arrangement to conduct grouting material to the space A between the closure C after they have been actuated or expanded into sealing engagement with the piling P to seal off the space A between the jacket J and piling P. Such arrangement includes a check valve 22 and a plug 23 arranged within an opening 25 and retained therein by a shear pin 24.

In this form of the invention, grouting material or a slug of water or brine injected in the line ahead of the grouting material may be employed as the inflating medium for the closure means C. When the internal pressure within the closure means C reaches a predetermined amount, the shear pin 24 will shear so that plug 23 is ejected into the space A. Thereafter, grouting material is discharged into the space A. When this occurs, the spring loaded check valve 22 closes and traps the inflating grouting or other inflating medium in each of the spaced closures C. Grouting material may be continually discharged down conduit 11 until the space A is filled. Return of grouting material through the conduit 16 will indicate that the space is filled and valve 28 provided in conduit 16 is closed and pressure maintained in space A to exert a compressive force on the grouting material in space A and maintain such pressure while the grouting material takes a permanent set. After the grouting material has taken a set, the pressure may be released from conduit 11 and valve V opened. The pressure on the grouting material as it is taking a permanent set will tend to impart a compressive strength to the grouting material for additional load sustaining capability. This will tend to increase the resistance towards shear between the jacket J and piling P and the grouting therebetween, as shown by the plane of shear between the grout and the steel sleeve as indicated by lines A'—A' and B'—B' in FIG. 7.

Figure 3:
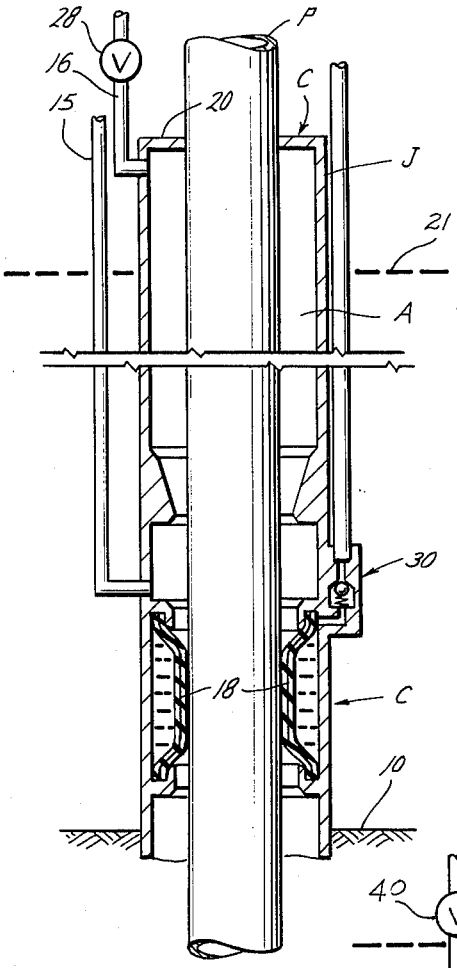
FIG. 3 shows an alternate form of closure means at one end of the jacket with an expandable seal means adjacent the lower end of the jacket for sealingly engaging a piling driven therethrough and showing a conduit system for actuating the seal means and for providing grouting material to the space between the jacket and the piling and the upper and lower closure means.

In FIG. 3, the jacket J is shown surrounding the piling P with the closure means C positioned adjacent to the upper and lower end of the jacket J. In this form, the upper closure means C comprises an annular closure 20, and may be welded or otherwise secured to the upper end of the jacket J and piling P above the water level 21 to seal off between the jacket J and piling P at the upper end of the jacket J. The lower closure C is in the form of an inflatable reinforced element 18. An inflating line 11 is provided having the arrangement 30 adjacent the inflatable element C as previously described. A separate grouting line 15 is provided for supplying grouting material to the space A and a grout return line 16 is provided which extends upwardly above the water level 21 to provide a visual or instrument indication of the filling of space A. The valve 28 is closed to aid in applying pressure to the grouting material in the space A while also maintaining pressure in the conduit 15 to provide a compressive force to the grouting material as it hardens, as described above.

Figure 4:
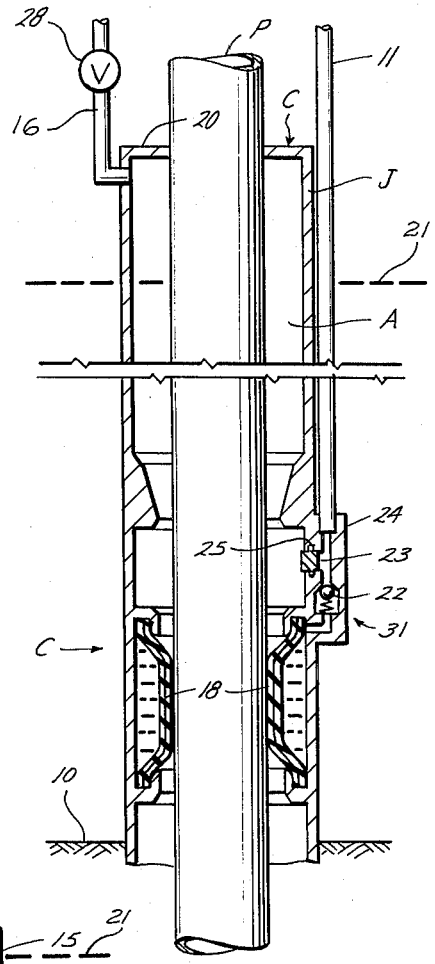
FIG. 4 is similar to FIG. 3 but shows an arrangement wherein a single conduit is provided for actuating the seal means, and for thereafter filling the space between the jacket and piling between the closure means.

The construction shown in FIG. 4 is similar to that shown in FIG. 3, but the grouting line 15 has been eliminated. In this form, the conduit or line 11 has the arrangement 31, including a spring loaded check valve means 22 and the plug 23 in opening 25 with a shear pin 24 therein so that after the lower inflatable element 18 has been expanded by the grouting or other fluid material to a predetermined pressure, the shear pin 24 will shear open the space A to receive grouting material through the conduit 11 and to trap the inflating fluid in the expandable element 18. Thereafter, the operation is as previously described.

Figure 5:
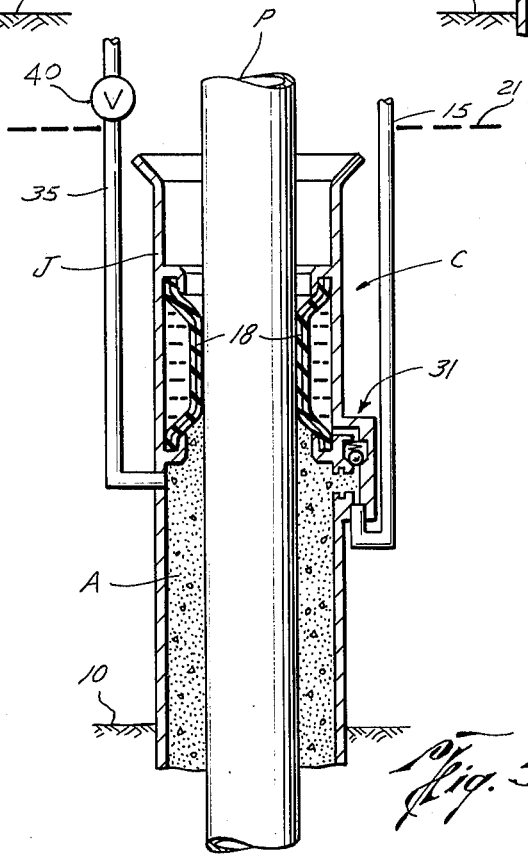
FIG. 5 shows another form of the present invention wherein expandable seal means are provided adjacent the upper end of a jacket and conduit means for inflating the seal means and providing grouting material to the annular space between the seal means and the lower end of the jacket as well as alternate conduit means for maintaining pressure on the grouting material in the space while it hardens.
Figure 7:
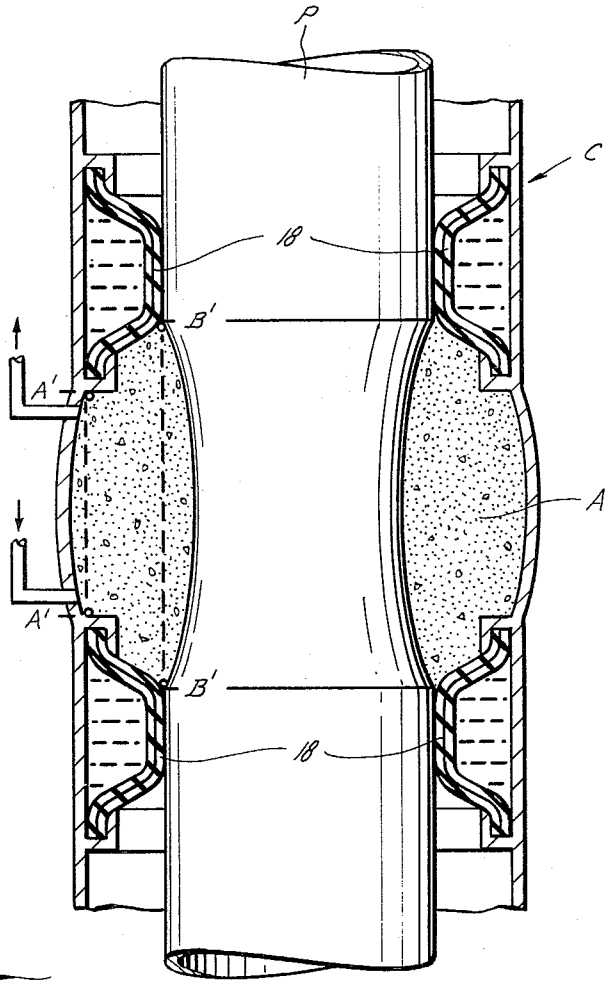
FIG. 7 is a schematic diagram illustrating the beneficial shear planes A′—A′, B′—B′ obtained when the grout is set using the method of the present invention. The expanded corrugated effect shown on the sleeve and the contracted wall of the piling should be noted.
Figure 6:
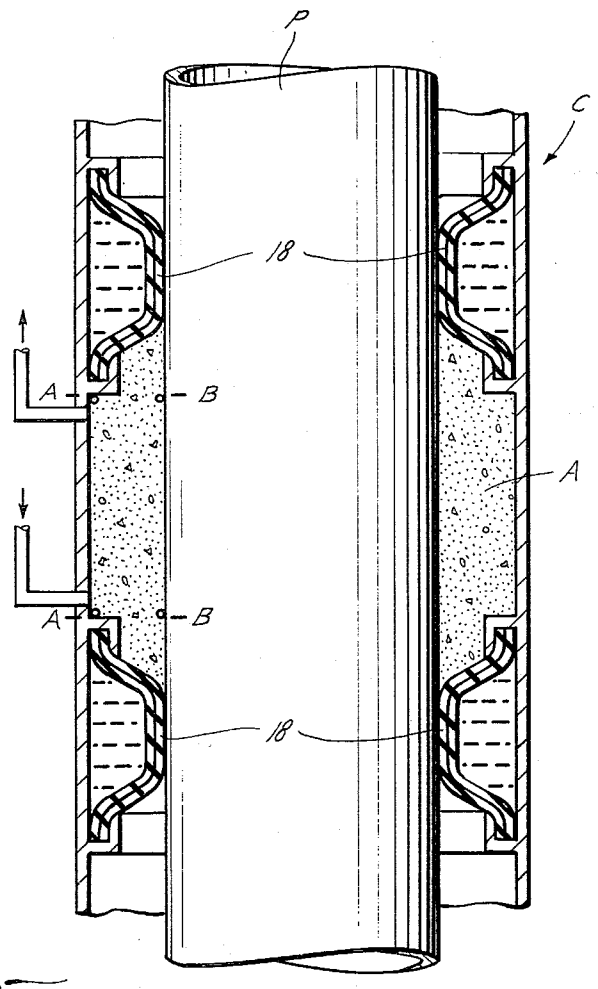
FIG. 6 is a schematic diagram illustrating a conventional grouting system and method showing concrete-steel shear planes A—A, between the grout and the sleeve and, B—B, between the grout and the piling.

Another form of the present invention is shown in FIG. 5, wherein the jacket J is shown surrounding piling P conventionally driven into the seabed 10. As shown in FIG. 5, a single closure C is at the upper end of the jacket J, such closure being in the form of an inflatable or expandable means 18 with which is communicated an inflation line 15 having the arrangement 31 which initially includes the spring loaded check valve 22, plug 23, and opening 25 with a shear pin 24 holding the plug 23 in position. The plug 23 is removed so that the grouting is discharged through opening 25. An additional conduit 35 is provided which extends upwardly above the water surface for communication with the space A formed between the piling P and the jacket J and between the closure at the upper end of the jacket J and the seabed 10. In the method of this form of the invention, the fluid inflating medium is provided to the annular expandable reinforced member 18 to seal off the space A at its upper end between the piling P and jacket J. When the necessary and predetermined inflation pressure is reached, the shear pin 24 shears thus enabling plug 23 to move out of opening 25 and this loss of pressure causes spring loaded check valve 22 to close to trap inflating fluid in the inflatable element 18. A pressurized medium may then be pumped down the conduit 15 with the valve 40 closed to expel the water and mud at the lower end of the skirt adjacent the seabed 10. A predetermined volume of grouting material is then pumped into the space A through the conduit 15 while slowly releasing pressure from conduit 35. Because the selected grout generally will have a specific gravity of approximately twice that of the sea water, and space A will not become completely filled with grout, as the grout will incrementally flow out of the open bottom of space A and through the porous sea bed therebelow until the cement column inside the sleeve approaches the static head of the sea water exterior of the space A. Thereafter, the set cement acts as a bottom seal for the space A and subsequent grouting of the column above the set cement may be initiated, with the valve 40 manipulated to open position to bleed off the fluid medium trapped above the set cement in the space A. Thereafter, the valve 40 is closed to increase pressure within the space A, and pressurized grouting is initiated as shown in FIG. 7 and as described above to completely fill the space A with the grouting medium.

It can be appreciated that, if desired, the grouting material may be employed to inflate the closure means C when the closure means C assumes the form of an inflatable element, or if desired, a suitable other inflating medium such as a compressed fluid medium like air or nitrogen may be employed to inflate the inflatable element.

Any suitable type of grouting material may be employed in the method of the present invention which will take a permanent set and which will under the environmental and other conditions described herein accomplish the desired function of sealing and filling the space A between the closure means C or between the closure means C and the seabed 10.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is desired to be secured by Letters Patent is:

1. A method of grouting an offshore structure positionable on a sea bed and having at least one supporting leg including a tubular sleeve in the water and a piling insertable in the sleeve, said piling having an outside diameter smaller than the inside diameter of the sleeve to thereby form an annular space between the sleeve and piling, said method comprising the steps of:

(a) Positioning normally contracted and selectively expandable seal means on the sleeve for isolating at least a portion of said annular space;

(b) Expanding the seal means to sealingly engage the piling (c) Discharging water from the annular space;

(d) Introducing a settable grouting material into the annular space under pressure; and (e) Releasing said pressure upon setting of said grouting material, the settable grouting material being introduced into the annular space and maintained under pressure until set, said pressure being greater than the static head pressure exerted by the grout column and water column at the grouting depth.

2. A method of grouting an offshore structure positionable on a sea bed and having at least one supporting leg including a tubular sleeve in the water and a piling insertable in the sleeve, said piling having an outside diameter smaller than the inside diameter of the sleeve to thereby form an annular space between the sleeve and piling, said method comprising steps of:

(a) Positioning normally contracted and selectively expandable seal means on the sleeve for isolating at least a portion of said annular space;

(b) Expanding the seal means to sealingly engage the piling;

(c) Discharging water from the annular space;

(d) Introducing a settable grouting material into the annular space under pressure; and (e) Releasing said pressure upon setting of said grouting material, the seal means being positioned adjacent the upper end of the sleeve whereby the annular space may be sealed off between the seal means and the sea bed, the settable grouting material being introduced into annular space and maintained under pressure until set, said pressure being greater than the static head pressure exerted by the grout column and water column at the grouting depth.

3. A method of grouting an offshore structure positionable on a sea bed and having at least one supporting leg including a tubular sleeve in the water and a piling insertable in the sleeve, said piling having an outside diameter smaller than the inside diameter of the sleeve to thereby form an annular space between the sleeve and piling, said method comprising the steps of:

(a) Positioning normally contracted and selectively expandable seal means on the sleeve for isolating at least a portion of said annular space;

(b) Expanding the seal means to sealingly engage the piling;

(c) Discharging water from the annular space;

(d) Introducing a settable grouting material into the annular space under pressure; and (e) Releasing said pressure upon setting of said grouting material, the seal means being positioned adjacent the upper and lower end of the sleeve whereby the annular space may be sealed off therebetween, the settable grouting material being introduced into the annular space and maintained under pressure until set, said pressure being greater than the static head pressure exerted by the grout column and water column at the grouting depth.

* * * * *